US008720113B1

(12) United States Patent
Krivoy

(10) Patent No.: US 8,720,113 B1
(45) Date of Patent: May 13, 2014

(54) NON-HANDED SWING DOOR OPERATOR

(71) Applicant: Paul Jules Krivoy, Corpus Christi, TX (US)

(72) Inventor: Paul Jules Krivoy, Corpus Christi, TX (US)

( * ) Notice: Subject to any disclaimer, the term of this patent is extended or adjusted under 35 U.S.C. 154(b) by 0 days.

(21) Appl. No.: 13/667,427

(22) Filed: Nov. 2, 2012

(51) Int. Cl.
*E05F 11/24* (2006.01)

(52) U.S. Cl.
USPC ..... 49/341; 49/339

(58) Field of Classification Search
USPC ..... 49/339, 340, 341, 343, 346
See application file for complete search history.

(56) References Cited

U.S. PATENT DOCUMENTS

| | | | | |
|---|---|---|---|---|
| 4,333,270 | A * | 6/1982 | Catlett | 49/336 |
| 5,221,239 | A | 6/1993 | Catlett | |
| 5,392,562 | A * | 2/1995 | Carambula | 49/346 |
| 5,878,530 | A * | 3/1999 | Eccleston et al. | 49/139 |
| 6,138,412 | A * | 10/2000 | Rieckmann et al. | 49/349 |
| 6,336,294 | B1 * | 1/2002 | Kowalczyk et al. | 49/339 |
| 6,510,586 | B1 * | 1/2003 | Ginzel | 16/79 |
| 7,143,547 | B2 | 12/2006 | Liles, Jr. | |
| 7,418,800 | B1 * | 9/2008 | Sellman | 49/340 |
| 7,555,867 | B2 * | 7/2009 | Liles, Jr. | 49/340 |
| 8,527,101 | B2 * | 9/2013 | Burris et al. | 700/282 |
| 2003/0005639 | A1 * | 1/2003 | Kowalczyk | 49/340 |
| 2007/0022664 | A1 * | 2/2007 | Mahonen et al. | 49/342 |
| 2009/0265992 | A1 * | 10/2009 | Hass et al. | 49/340 |
| 2012/0023827 | A1 * | 2/2012 | Hancock et al. | 49/360 |

* cited by examiner

*Primary Examiner* — Katherine Mitchell
*Assistant Examiner* — Catherine A Kelly

(57) ABSTRACT

A non-handed door operator comprising a motor connected to a mounting plate; at least one gear assembly coupled to the motor and having a driven gear and a driving gear; a gear coupled to the at least one gear assembly; a shaft fixed to the gear and rotatable around an axis in a first rotational direction, the shaft having a first end and an opposing second end; at least one cam positioned on the shaft and having a shell of revolution about the shaft axis; at least one switch intersecting the shell of revolution of the at least one cam; and an arm attachable to the first end and the second end of the shaft.

10 Claims, 8 Drawing Sheets

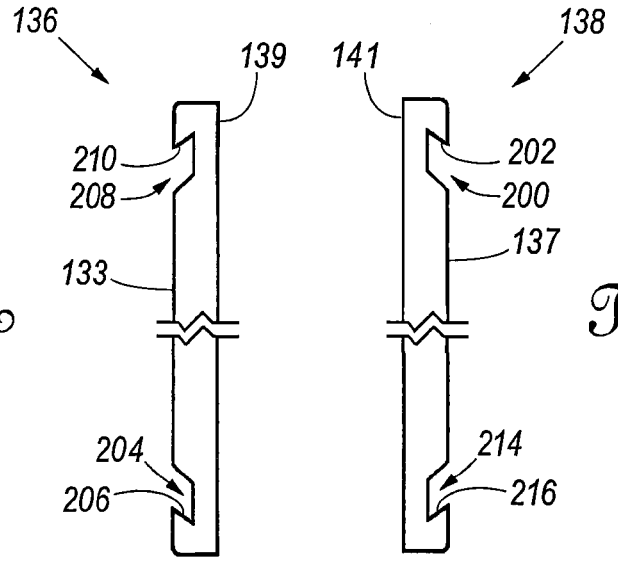
Fig. 4A
Fig. 4B
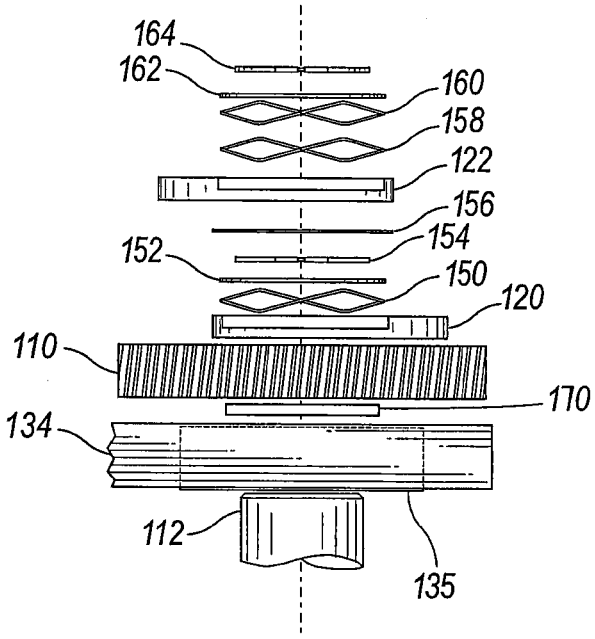
Fig. 5

NON-HANDED SWING DOOR OPERATOR

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND

1. Field of the Invention

The present invention relates to swing door operators. More specifically, the present invention is a non-handed swing door operator.

2. Description of the Related Art

Many public buildings have swing doors attached to automated door opening units, or "operators." These mechanisms may be connected to, for example, a motion sensor or a push button in order to relieve patrons of the burden of opening the doors. When the motion sensor is triggered, or the button pushed, a motor causes rotation of an arm about an axis, with the arm being connected to the door to be moved to a fully open position. The motor, or some other mechanism, may then cause the door to return to a fully closed position.

Conventional terms for standard configurations of doors and operators include an "inswing," which on a left-hand door (i.e., attached to the door frame at the door left edge) would be a counter-clockwise rotation when viewed from above. Similarly, an inswing would be a clockwise rotation on a right-hand door (i.e., attached to the door frame at the door right edge). An "outswing" for a left-hand door would be a clockwise rotation when viewed from above. An outswing for a right-hand door would be a counter-clockwise rotation. In an actual installation, the person entering a right-hand door from the front would see the right-hand door panel move toward him.

Conventionally, door operators may be designated as (1) a "left hand" unit (an "LH" unit), which causes an inswing on a left-hand door, (2) a "left hand reverse" unit (an "LHR" unit), which causes an outswing on a left-hand door, (3) a "right-hand" unit (an "RH" unit), which causes an inswing on a right-hand door, and (4) a "right hand reverse" unit (an "RHR" unit), which causes an outswing on a right-hand door.

These designations are also used with double doors, which have individual opening units for the left and right doors. For a double door installation requiring an inswing, LH and RH units would be used on the left and right doors, respectively. For a double door installation requiring an outswing, LHR and RHR units would be used on the left and right doors, respectively.

As a result of these various configurations, a service technician is currently required to carry each possible configuration of a unit to be prepared for each of the four possible unit failures at sites. Another problem with existing operators is the inability to quickly and efficiently remove the motor because access to motor mounting screws is blocked by one or more of the gear assemblies. As a result, to access the motor mounting screws, one or more gears must be removed, which may result in damage to the gears and difficulty in proper realignment of the gears when they are replaced.

Yet another problem relates to alignment of cams that cause actuation of cam switches when the operator arm is in various positions. Over time, rotational alignment of the cams can slip, necessitating realignment to ensure proper operating range of the swing door.

BRIEF SUMMARY OF THE INVENTION

The present invention is a non-handed door opening unit for new installations, and also for replacing existing units in any of the LH, LHR, RH, and RHR configurations. The present invention further allows cam adjustment without the necessity of accessing set screws or pushing with fingertips, and allows simple access to motor mounting screws. Another feature of the present invention includes mounting channels on either side of the sideplates, which allows the present invention to be used as a replacement part to fit other single-handed swing door operators that require service or replacement.

The present invention comprises a motor connected to a mounting plate; at least one gear assembly coupled to the motor and having a driven gear and a driving gear; a gear coupled to the at least one gear assembly; a shaft fixed to the gear and rotatable around an axis in a first rotational direction, the shaft having a first end and an opposing second end; at least one cam positioned on the shaft and having a shell of revolution about the shaft axis; at least one switch intersecting the shell of revolution of the at least one cam; and an arm attachable to the first end and the second end of the shaft.

BRIEF DESCRIPTION OF THE DRAWINGS

FIGS. 4A and 4B are elevations along lines 4A and 4B of FIG. 4, respectively.

FIG. 5 is an exploded view of the cams and related components of the embodiment.

DETAILED DESCRIPTION OF THE VARIOUS EMBODIMENTS

Figure 1:
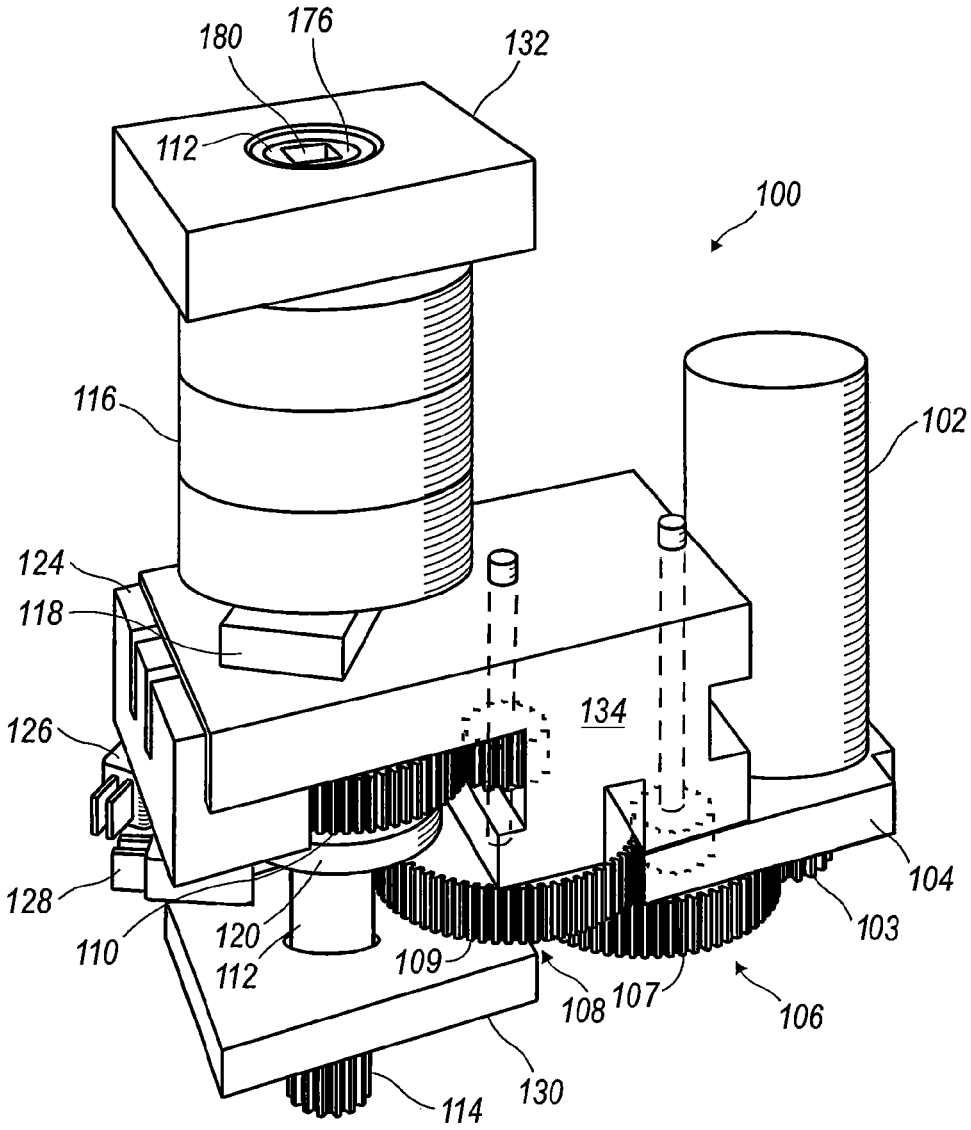
FIG. 1 is an oblique view of an embodiment of the present invention.
Figure 2:
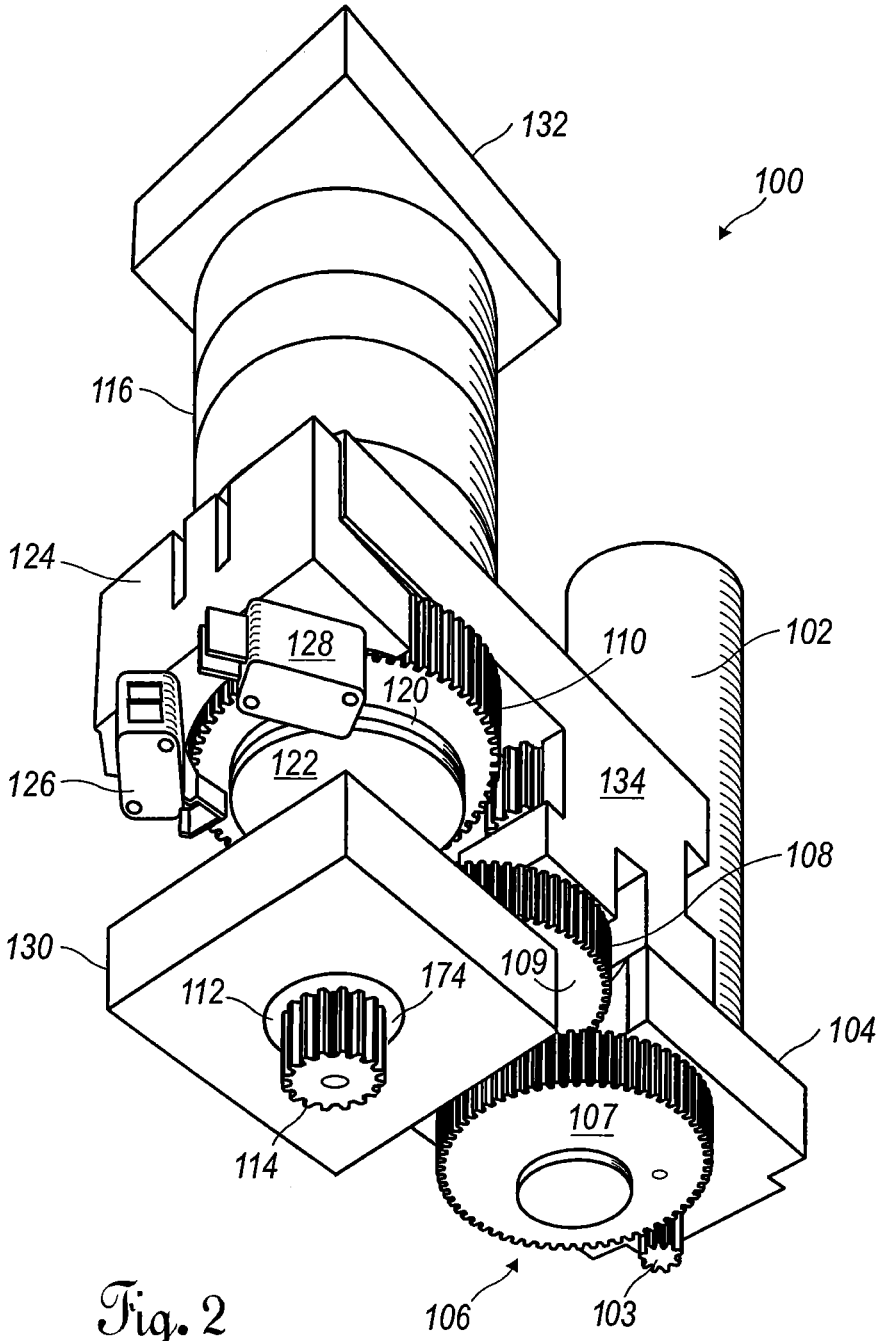
FIG. 2 is a second oblique view of the embodiment shown in FIG. 1.

As shown in FIGS. 1-2, an embodiment 100 of the invention comprises a motor 102 having a motor gear 103, a motor mounting plate 104, a first gear assembly 106 having a driven gear 107 coupled to and rotatable by the motor gear 103, a second gear assembly 108 having a driven gear 109 coupled to and rotatable by the first gear assembly 106, a third gear 110 coupled to and rotatable by the second gear assembly 108, a shaft 112 rotatable by the third gear 110, a detachable drive gear 114 positioned in a first position on, and rotatable with, the shaft 112, a coil spring 116 connected to the shaft 112, a shaft stop 118 positioned on the shaft 112, a first cam 120 and a second cam 122 positioned on the shaft 112, a cam switch plate 124, a first cam switch 126, a second cam switch 128, a first bearing block assembly 130, a second bearing block assembly 132 and a bracket 134 supporting the motor mounting plate 104, the cam switch plate 124, the first and second bearing blocks 130, 132, and the first gear assembly 106, second gear assembly 108, and third gear 110.

Each gear assembly 106, 108 includes a smaller drive gear housed within the bracket 134, with the motor gear 103 or drive gear of an assembly being coupled to the driven gear of a different assembly or of the third gear 110. Although the gears of the embodiment 100 are shown as spur gears, alternative embodiments contemplate the use of helical and other types of gears.

Figure 3:
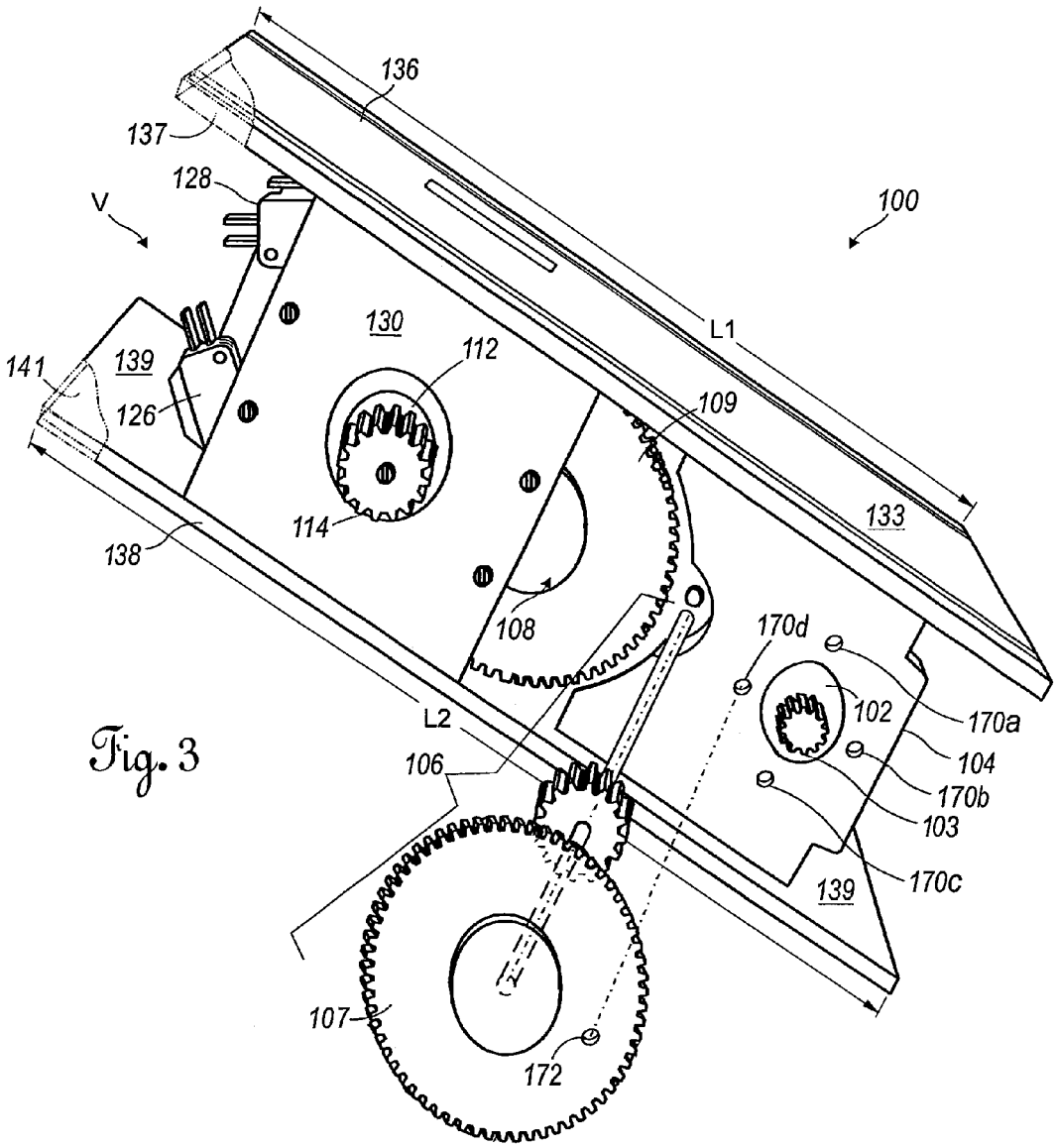
FIG. 3 is a third oblique view of the embodiment.

As shown in FIG. 3, the embodiment 100 may have a first sideplate 136 and a second sideplate 138 for connection to a mounting structure (not shown). The first sideplate 136 has a first outer surface 133, a first inner surface 137 mounted to the motor mounting plate 104, and a first length L1. The second sideplate 138 has a second outer surface 141, a second inner surface 139 mounted to the motor mounting plate 104, and a second length L2 that is equal to the first length L1. The first sideplate 136 and second sideplate 138 are spaced apart to define a volume V that intersects the motor 102 and the motor mounting plate 104. The embodiment 100 is in a RH position for causing a door panel mounted along the door panel's right edge to swing in (when viewed from the front, i.e., the opposite side to the side on which the opening embodiment is mounted). This involves the shaft 112 and attached drive gear and the door panel rotating in a clockwise direction $D_{CW}$. The first sideplate 136 will face out in this RH position.

Still referring to FIG. 3, the motor mounting plate 104 has four screw holes 170*a-d* for mounting the motor 102. One hole 170*d* is adjacent to and generally inaccessible when the embodiment 100 is assembled because of the relative position of the driven gear 107. An access hole 172 extends through the driven gear 107 between its cylindrical side surfaces and is alignable with the hole 170*d*, in which position access is provided to hole 170*d* behind the drive first gear 107.

Figure 4:
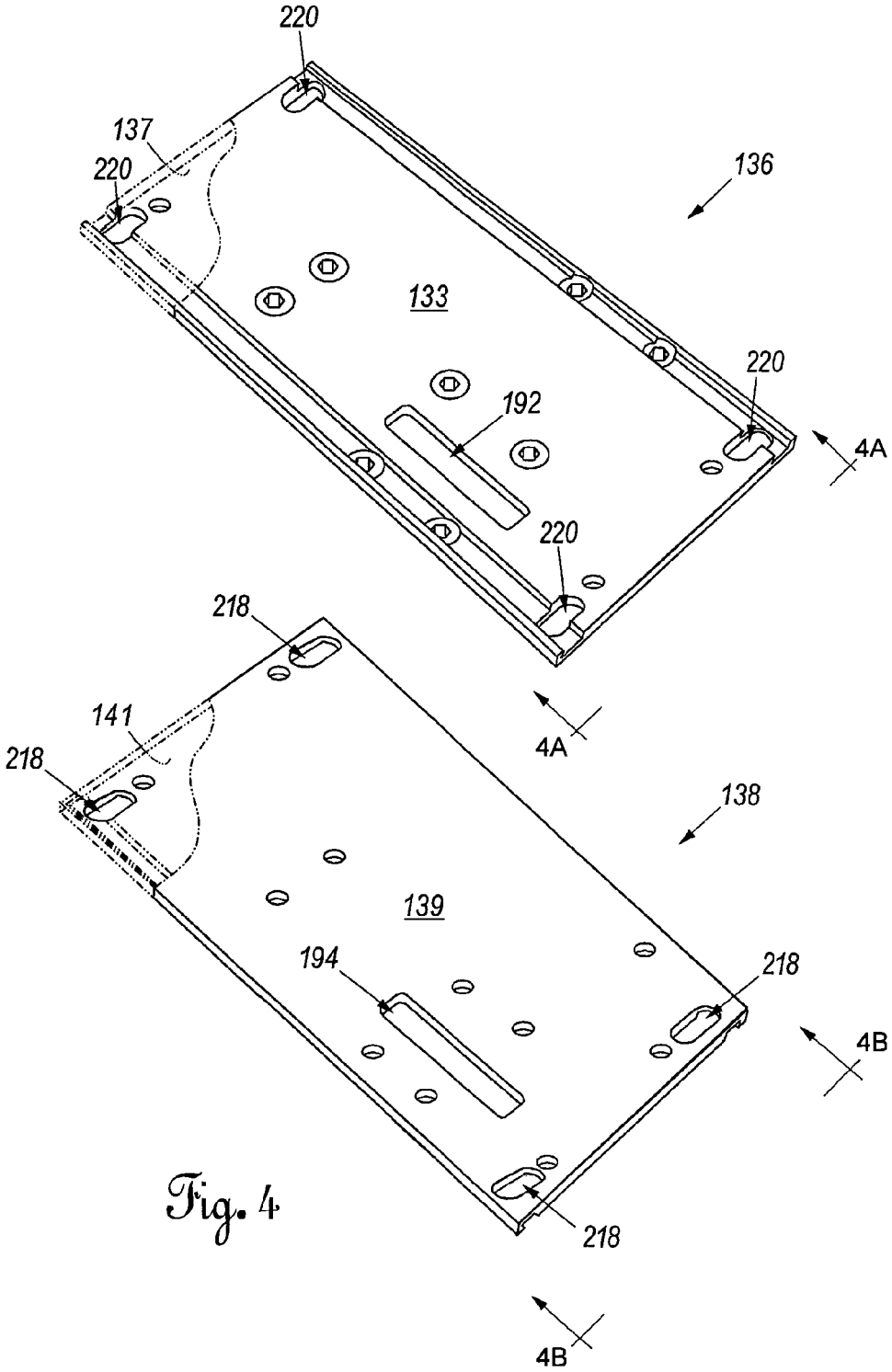
FIG. 4 is an oblique view of the sideplates of the embodiment.

As shown in FIG. 4, the first sideplate 136 and second sideplate 138 have cam access slots 192, 194 for allowing tool tip access to the space between the plates 136, 138. When the embodiment 100 is in an RH configuration (e.g., as shown in FIG. 3), with the first sideplate 136 facing out from the back of the door, one slot 192 is positioned to provide the tool tip access to the cams 120, 122. If the RHR door opening motion is desired, the operator rotates the entire embodiment 100. When in this position the sideplate 138 is now facing out from the back of the door frame, and tool tip access to the cams 120, 122 is through the second access slot 194.

As shown in FIGS. 4A-4B, a first slot 204 and a second slot 208 extend along the length of the first sideplate 136, and a third slot 200 and a fourth slot 214 extend along the length of the second sideplate 138. First and second lip surfaces 206, 210 are adjacent to the first outer surface 133 and partially define the first and second slots 204, 208, respectively. Thid and fourth Second and third lip surfaces 202, 216 are adjacent to the second outer surface 137 141 and partially define the third and fourth second and third slots 200, 214, respectively. The second slot 208 is a mirror of the first slot 204, and the fourth slot 214 is a mirror of the third slot 200. When the embodiment 100 is in an RH position, the second sideplate 138 faces the door frame structure and the lip 202 is facing downwardly. Similarly, if the embodiment 100 is in a RHR configuration, the first sideplate 136 faces the mounting structure and the slot 208 and lip 210 would then be positioned to be received by the mounting structure, such that lip 210 suspends the embodiment 100 from the mounting structure.

Referring back to FIG. 4, the embodiment 100 may alternatively be used with a mounting structure having protruding bolts, which would be received through sideplate openings 218 and sideplate openings 220, for a RH and a RHR configuration, respectively. Conventional fasteners would be used with the bolts, thus securing the respective sideplate to the mounting structure.

Referring to FIG. 5, the positioning of the first and second cams 120, 122 on the shaft 112 further comprises positioning the first cam 120 adjacent the third gear 110, followed by a first spring washer 150, a first flat washer 152, a first snap ring 154, a shim 156, the second cam 122, a second spring washer 158, a third spring washer 160, a second flat washer 162, and a second snap ring 164. These elements are compressably affixed to the shaft 118 such that the first snap ring 154 compresses the first spring washer 150, first flat washer 152, and first cam 120 against the third gear 110. The shim 156, second cam 122, second spring washer 158, third spring washer 160, and second flat washer 162, are compressably positioned on the shaft 112 by the second snap ring 164 as the second snap ring is positioned in a second shaft circumferential slot. A spacer 170 is positioned between the bracket 134 and the third gear 110 and a bearing 135 supports the shaft 112 in the bracket 134.

Figure 6:
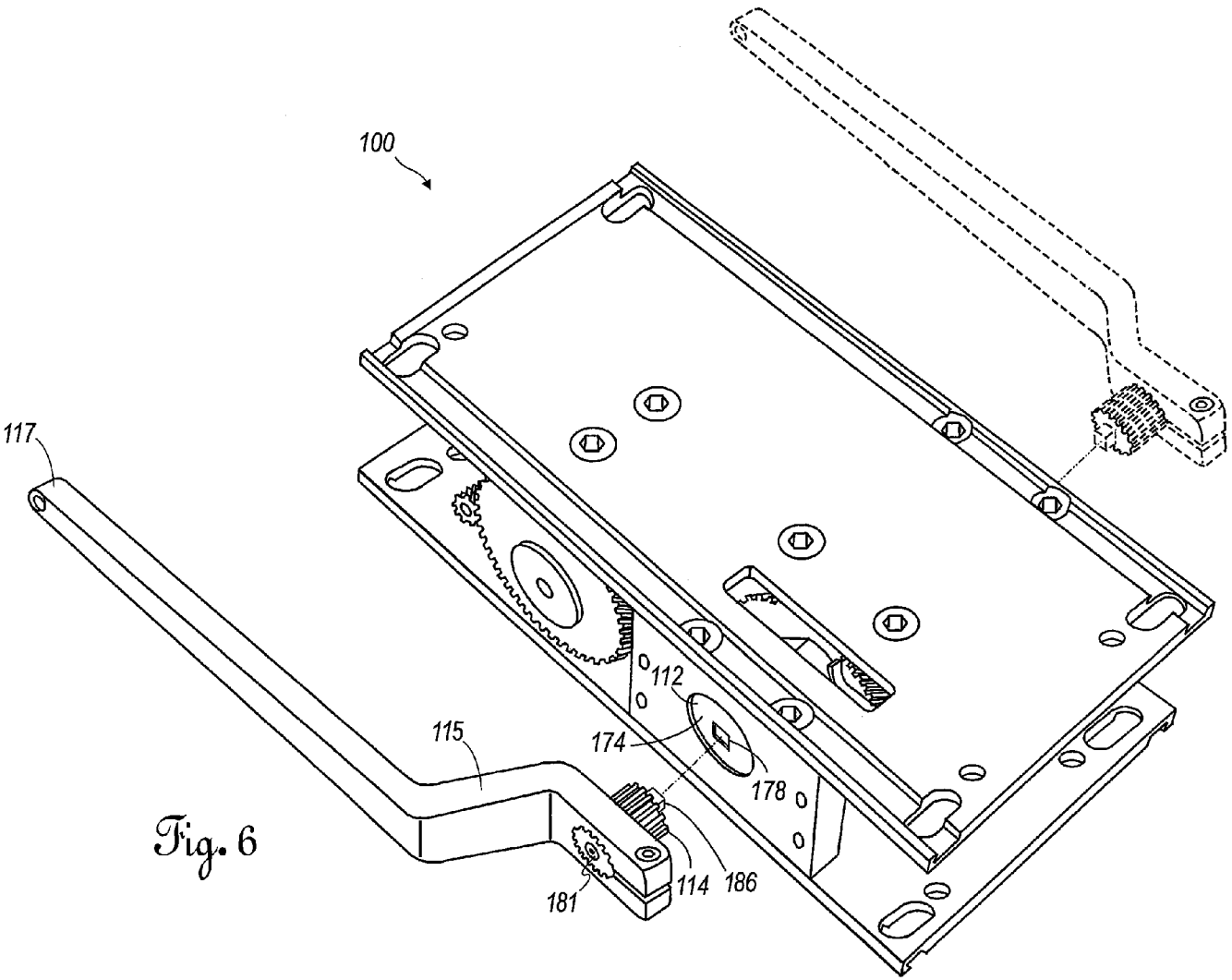
FIG. 6 is another oblique view of the embodiment showing an arm in multiple configurations.

Referring to FIG. 6, the shaft 112 has a first end 174 and a second end 176 (see FIG. 1), each having a distal, substantially square-shaped opening 178, 180. The shaft ends 174, 176 accept the drive gear 114, which has a substantially square extension 186. During assembly, the square extension 186 is positioned in either of the shaft end openings 178, 180, and a bolt 181 is inserted through the drive gear 114, through one of the shaft end opening 178, 180 and then threaded into the interior of shaft 112, thus securing the drive gear 114 to the shaft 112. Preferably, the bolt 181 has a female hexagonal opening for being driven by a hexagonal head wrench. The shaft 112 has a reduced diameter to accommodate the outer edge of the second gear 109 (see FIG. 1). An arm 115 is then connected to the drive gear 114 and has an end 117 for connection to a door arm assembly (not shown).

In this embodiment 100, a downwardly facing drive gear 114 and the attached arm 115 cooperates with a door arm assembly to move a door. This gear 114 rotates with the shaft 112, which has only one powered rotational direction.

For this embodiment 100 to be "non-handed," it must also be capable of LHR operation where the door panel movement is an outswing. Because the shaft 112 is only driven in one direction, the embodiment 100 must be rotated to have the shaft 112 rotating in the clockwise direction needed for a left door outswing. This moves the drive gear 114 to an upwardly facing direction. Because the drive gear 114 is non-functional in this position, the embodiment 100 must provide a downwardly facing drive gear 114. This can be accomplished by removing the drive gear 114 and repositioning it at the second end 176 of the shaft 112, where it would then be rotating in a clockwise direction and initiating outswing movement of the door panel.

Figure 7A:
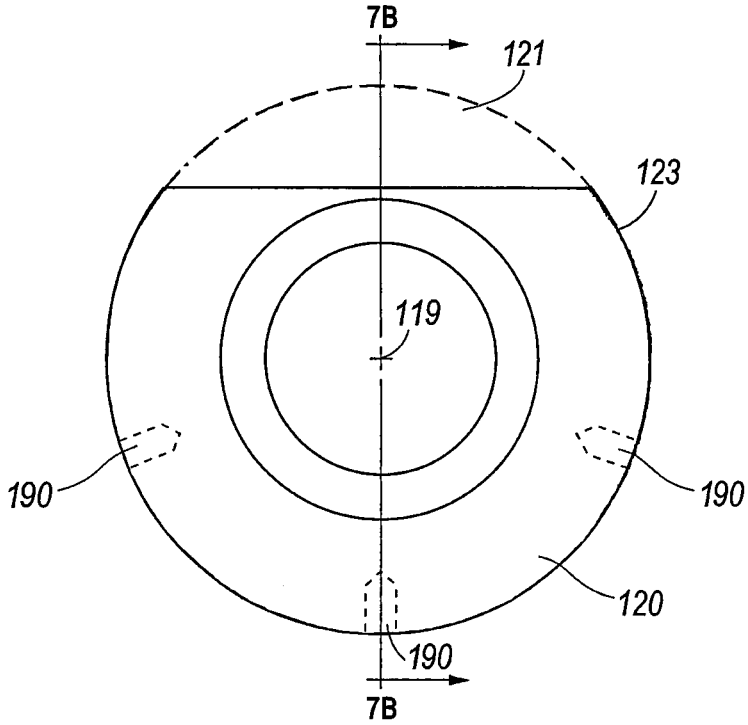
FIGS. 7A & 7B are elevations of a cam of the embodiment.
Figure 7B:
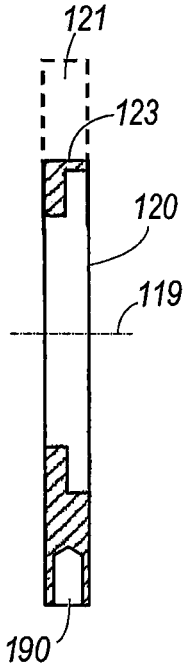

Referring to FIG. 7A-7B, the first cam 120 has a radial surface 123 with flat and curved portions, and openings 190 disposed through the radial surface 123. The openings 190 may receive a tool tip, such as the tip of a screw driver, for adjusting the cam 120 relative to the shaft 112. The first cam 120 defines a shell of revolution 121 around its center axis 119. The second cam 122 is identical to the first cam 120 in all respects, and defines an identically sized and shaped shell of revolution around its own axis.

Figure 8:
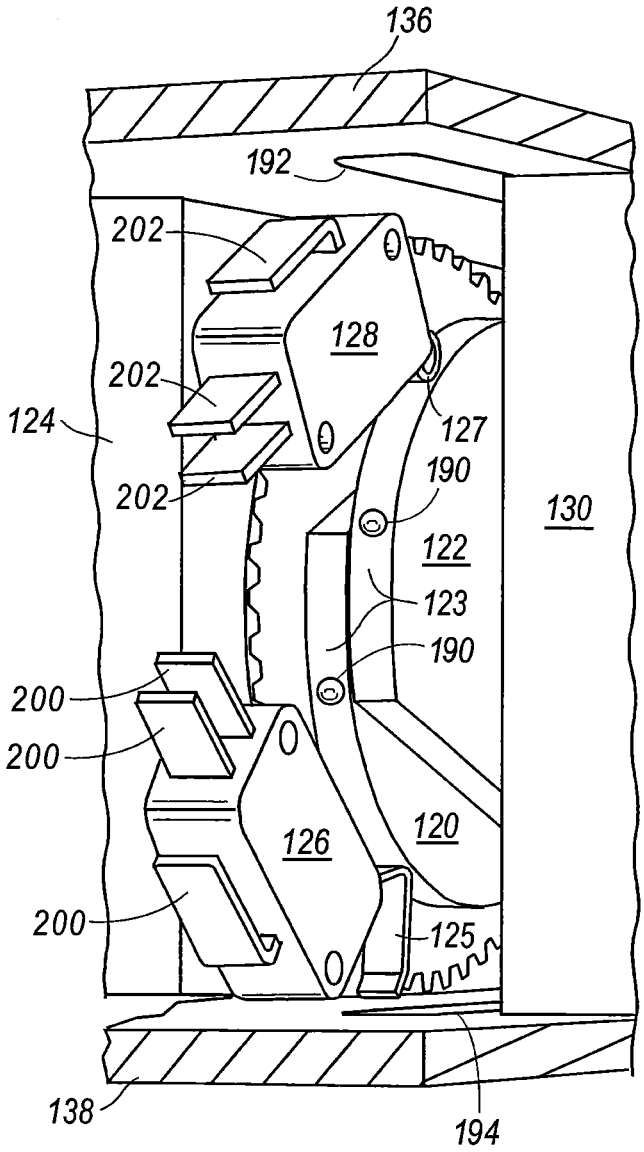
FIG. 8 shows the cam switches and related components of the embodiment.

Referring to FIG. 8, cams 120, 122 are positioned in a volume between the access holes 192, 194 in the first and second sideplates 136, 138. The cam openings 190 are accessible through the access slots 192, 194 with a tool tip. The first cam switch 126 is mounted to the cam switch plate 124 and has a toggle 125 that intersects the shell of revolution of the first cam 120. The second cam switch 128 is mounted to the cam switch plate 124 and has a toggle 127 that intersects the shell of revolution of the second cam. As the first and second cams 120, 122 rotate with the shaft 112 (not shown), the toggles 125, 127 either open or close the switch contacts, depending on whether each toggle is in contact with the curved portion or the flat portion of the radial surface of the associated cam. A controller programmed for conventional automatic door opening sequential stages may be electrically coupled to the cam switches 126, 128, and receive signals representative of a cam 120, 122 position through the switch contacts 200, 202. Conventional input devices can be used that signal the controller to begin a door opening sequence.

The present invention is described in terms of a preferred embodiment in which a specific door operator and alternatives are described. Those skilled in the art will recognize that additional alternative embodiments can be used in carrying out the present invention. Other aspects and advantages of the present invention may be obtained from a study of this disclosure and the drawings, along with the appended claims.

The invention claimed is:

1. A door operator attachable to a door operator mounting structure, the door operator comprising:

a motor mounting plate;

a motor connected to said motor mounting plate;

at least one gear assembly coupled to said motor and having a driven gear and a driving gear;

a gear coupled to said at least one gear assembly;

a shaft fixed to said gear and rotatable around a shaft axis in a first rotational direction, said shaft having a first axial end and an opposing second axial end;

a bracket fixed to said motor mounting plate, said at least one gear assembly, and said shaft;

a first sideplate having a first length, a first inner surface fixed to the bracket, a first outer surface opposing said first inner surface, a first lip surface adjacent to said first outer surface and at least partially defining a first slot adjacent to said first outer surface and extending along said first length, and a second lip surface adjacent to said first outer surface and at least partially defining a second slot adjacent to said first outer surface and extending along said first length;

a second sideplate spaced a distance from the first sideplate to define a volume between said first sideplate and said second sideplate, said volume intersecting said motor and said motor mounting plate, said second sideplate having a second length, a second inner surface fixed to the bracket, a second outer surface, a third lip surface adjacent to said second outer surface and at least partially defining a third slot adjacent to the second outer surface and extending along said second length, and a fourth lip surface adjacent to said second outer surface and at least partially defining a fourth slot adjacent to said second outer surface and extending along said second length; and an elongate arm operationally mounted to either said first end or said second end of said shaft.

2. The door operator of claim 1 further comprising:

at least one cam positioned on said shaft and having a shell of revolution about the shaft axis; and at least one switch intersecting the shell of revolution of said at least one cam.

3. The door operator of claim 1 further comprising a drive gear attached to said arm and said shaft.

4. The door operator of claim 1 further comprising:

at least one motor mounting hole extending between opposing sides of said motor mounting plate, said motor mounting hole having a first axis parallel to said shaft; and wherein the at least one gear assembly has an access hole therethrough, said access hole axially alignable with said at least one motor mounting hole.

5. The door operator of claim 1 wherein the door operator is vertically rotatable between an RH and an RHR configuration.

6. The door operator of claim 1 wherein said motor, said at least one gear assembly, said gear, and said shaft are at least partially within the volume defined by said first and second sideplates.

7. The door operator of claim 1 wherein said first slot and said second slot extend only partially between said first outer surface and said first inner surface.

8. The door operator of claim 4 wherein said at least one gear assembly further comprises a driven gear having a cylindrical surface circumscribing a second axis and defining said access hole, said second axis axially alignable with said first axis.

9. The door operator of claim 7 wherein said third slot and said fourth slot extend only partially between said second outer surface and said second inner surface.

10. The door operator of claim 1 wherein said first length is equal to said second length.

* * * * *